United States Patent [19]

Chen

[11] Patent Number: 5,002,154

[45] Date of Patent: Mar. 26, 1991

[54] STRUCTURE OF PORTABLE OIL SUMP RESIDUAL ENGINE OIL SUCTION PUMP DEVICE

[76] Inventor: Kuo-Neng Chen, No. 5, Alley 4, Lane 19, Jui Feng St., Taichung, Taiwan

[21] Appl. No.: 516,314

[22] Filed: Apr. 30, 1990

[51] Int. Cl.[5] ..... F16N 33/00

[52] U.S. Cl. ..... 184/1.5; 141/65; 141/27; 222/385

[58] Field of Search ..... 184/108, 1.5, 28; 141/65, 27, 26, 25, 59, 198, 216, 212, 229; 222/385

[56] References Cited

U.S. PATENT DOCUMENTS 1,439,295 12/1922 Craig ..... 184/1.5
2,029,781 2/1936 McLean ..... 184/1.5
3,929,155 12/1975 Garretson ..... 141/198

*Primary Examiner*—Ira S. Lazarus
*Assistant Examiner*—Alan B. Cariaso
*Attorney, Agent, or Firm*—Bacon & Thomas

[57] ABSTRACT

A portable oil sump residual engine oil suction pump device, which comprises an oil reservoir having received therein a pump body to change the inner space of the oil reservoir into a negative pressure status so as to efficiently induce residual engine oil from an oil sump into the oil reservoir. A floating choke valve is fastened inside the oil reservoir at an upper position, which follows the filling of certain quantity of engine oil in the oil reservoir to block up a passage way to the pump body so as to stop the formation of vacuum and prohibit from entering of engine oil in the pump body.

3 Claims, 5 Drawing Sheets

STRUCTURE OF PORTABLE OIL SUMP RESIDUAL ENGINE OIL SUCTION PUMP DEVICE

BACKGROUND OF THE INVENTION

The present invention is related to suction pump devices and more particularly to a portable suction pump device for sucking up residual engine oil from an oil sump of a vehicle.

In recent years, because of economic and industrial prosperity automobile has now become one of the most popular personal transportation vehicles in most countries in the world. However, the use of an automobile brings in certain maintenance problems. More particularly, the engine oil of an automobile must be regularly changed. An automobile owner may encounter the following problems while going to change engine oil:

1. It is expensive to go to a repair shop for changing engine oil.

2. If the engine oil of an automobile is not changed in time because no repair shop available or because repair shops are out of service time, the mechanical parts of an automobile may wear off easily.

3. Because the drain port of an oil sump of an automobile is generally made on the bottom of an oil sump, is very difficult to drain residual engine oil from an oil sump by an automobile owner if one wishes to change engine oil by oneself.

4. Because the drain port of an oil sump of an automobile is generally raised from the surface of the inner bottom of an oil sump, residual engine oil can not be completely drained out of an oil sump without the use of any special tool. Therefore, it is very difficult to completely change the residual engine oil of an oil sump with fresh engine oil by an automobile owner or a car driver.

SUMMARY OF THE INVENTION

The present invention has been accomplished under the circumstances in view. It is an object of the present invention to provide a portable oil sump residual engine oil suction pump device which can efficiently completely suck up residual engine oil from an oil sump without causing any pollution.

According to the present invention, a portable oil sump residual engine oil suction pump device comprises a cylindrical oil reservoir having received therein an one-way air pump at the center. The air intake hole of the one-way air pump is in communication with the top end of the oil reservoir. An oil suction pipe is mounted on the top of the oil reservoir for insertion in an oil sump so that the residual engine oil can be sucked up by the one-way air pump into the oil reservoir. The device of present invention can also be used for sucking up brake oil, gear oil or gear box lubricating oil.

BRIEF DESCRIPTION OF THE DRAWINGS

The present invention will now be described by way of example, with reference to the annexed drawings, in which.

DETAILED DESCRIPTION OF THE PREFERRED EMBODIMENT

Figure 2:
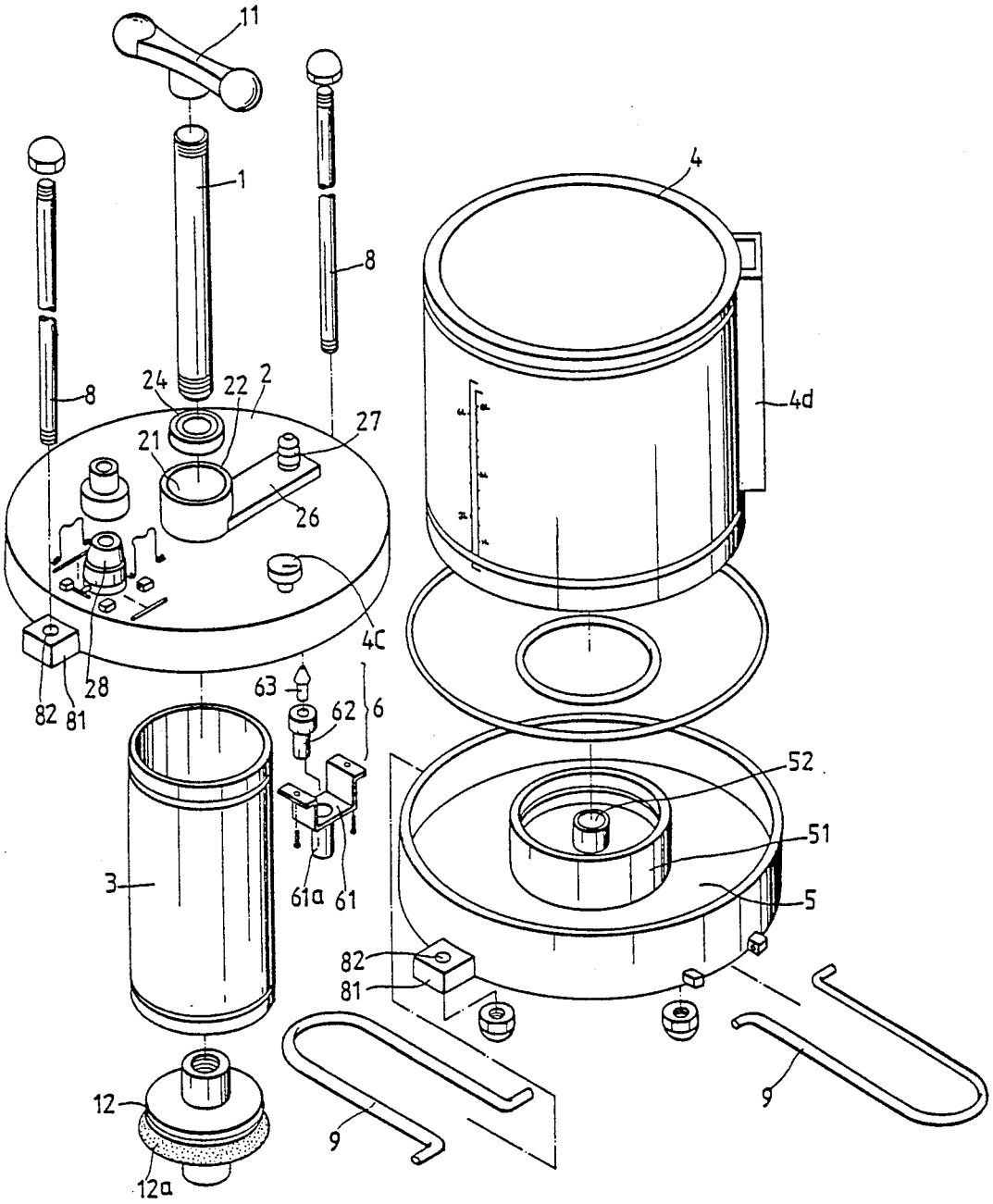
FIG. 2 is a perspective exploded view thereof.

Referring to FIG. 2, a portable engine oil suction pump device is shown and generally comprised of a pressure bar 1, an upper cover 2, a pump body 3, an oil reservoir 4, a base 5 and a floating choke valve 6.

Figure 3:
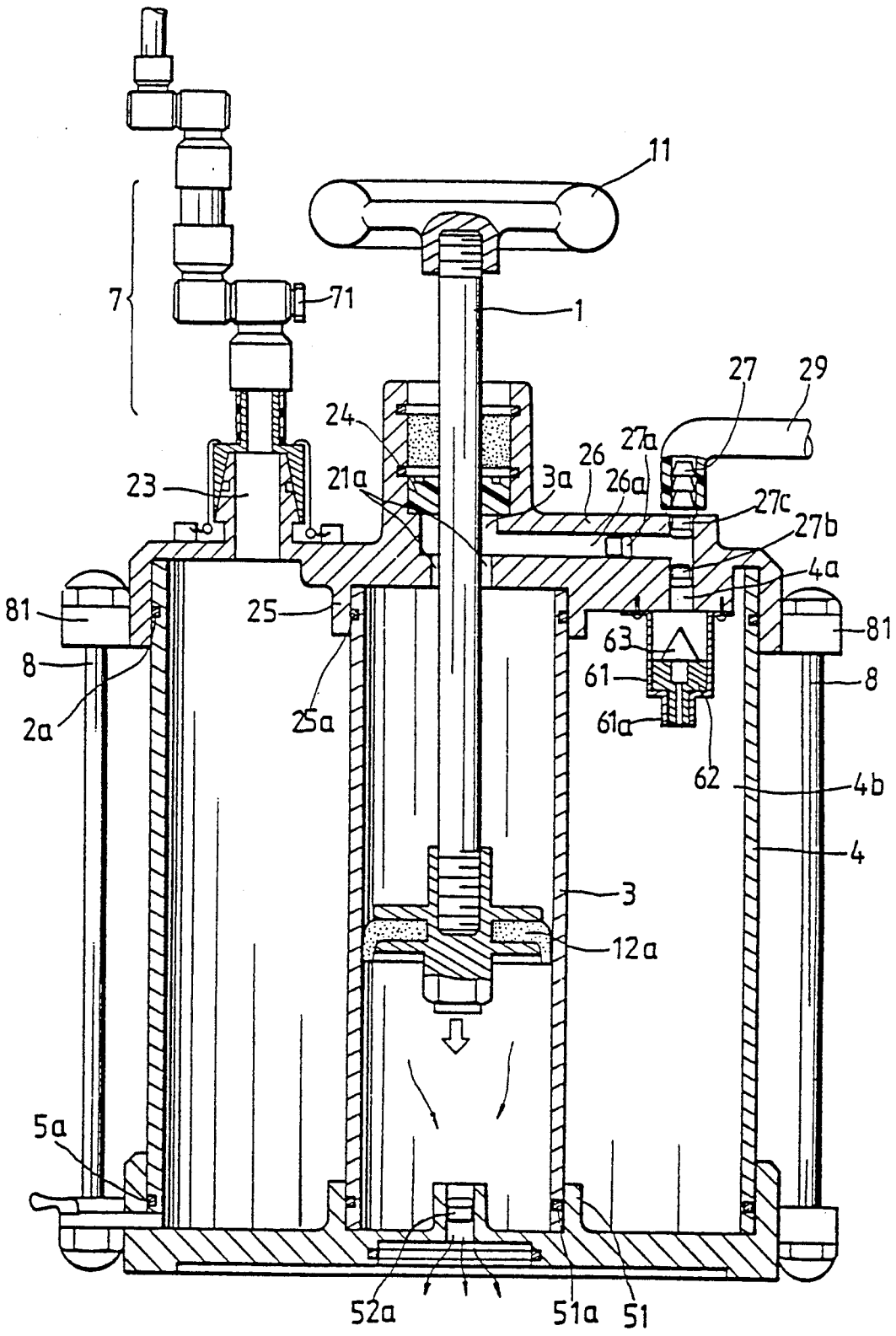
FIG. 3 is a longitudinally sectional view thereof.

As illustrated in FIGS. 2 and 3, a through-hole 21 is made at the center of the upper cover 2 and surrounded by a circular flange 22. An elongated rib 26 is made on the top surface of the upper cover 2 extending from the circular flange 22 and defining therein an air channel **26*a* the both ends of which are respectively in communication with the through-hole 21 and the bottom surface of the upper cover 2 (see FIG. 3). A circular projection 25 projects downward from the bottom surface of the upper cover 2. The base comprises a vertical wall around its periphery, a through-hole 52 at its center with an one-way valve 52*a* set therein, and a circular projection 51 projecting upward therefrom and made at location corresponding to the circular projection 25 of the upper cover 2. The pump body 3 and the oil reservoir 4 are mounted on the base 5 and covered by the upper cover 2. As illustrated in FIG. 3, the pump body 3 is received inside the oil reservoir 4 with its two opposite ends respectively fastened in the circular projections 25, of the upper cover 2 and the base 5 and sealed with two O-rings 25*a*, 51*a* respectively. Therefore, the oil reservoir 4 becomes tightly sealed to define an enclosed space therein. The base 5 and the upper cover 2 have each a plurality of lugs 81 transversely extending outward from its periphery, in which each lug 81** has a through-hole vertically piercing therethrough.

After the pump body 3 and the oil reservoir 4 are respectively secured between the base 5 and the upper cover 2, a plurality of bolts 8 are vertically inserted through the through-holes 82 of the lugs 81 of the upper cover 2 into the through-holes 82 of the lugs 81 of the base 5 to fixedly secure the base 5 and the upper cover 2 together permitting the pump body 3 and the oil reservoir 4 to be firmly squeezed in therebetween.

The pressure bar 1 is inserted in the pump body 3 with its top end protruding beyond the upper cover 2 for the connection thereto of a handhold 11 and with its bottom end coupled with an one-way valve 12 which comprises a flexible valve flap 12 (see FIG. 3). A plurality of vent gaps **21*a* are defined between the through-hole 21 of the upper cover 2 and the pressure bar 1, which are respectively in communication with the air channel 26*a* of the elongated rib 26 to form therewith an air intake hole 3*a* for the pump body 3. A seal ring 24 is mounted on the pressure bar 1 and set inside the through-hole 21 of the upper cover 2 to protect against entering of outside air into the pump body 3 through the air intake hole 3*a***.

Figure 1:
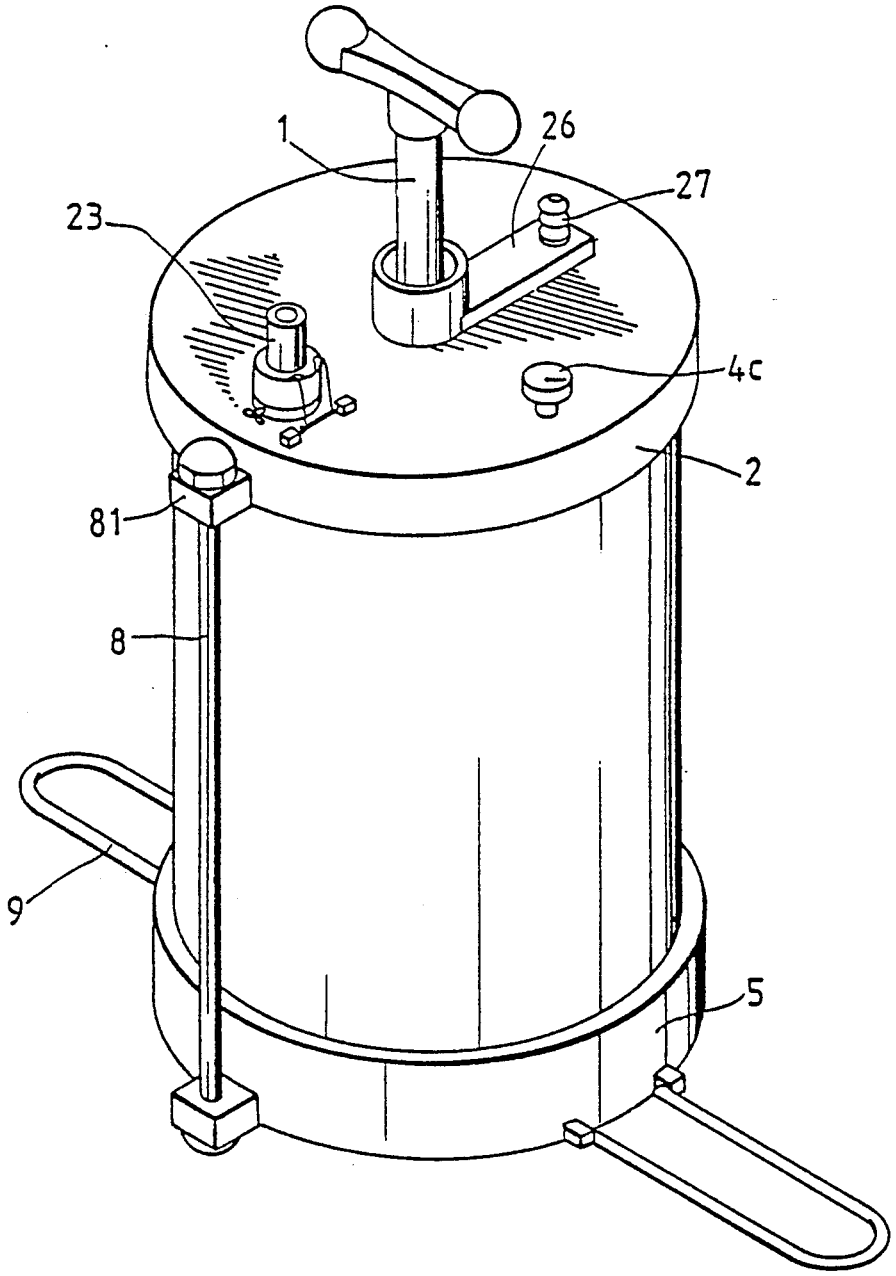
FIG. 1 is a perspective view of an engine oil suction pump device embodying the present invention.

Referring to FIG. 3 again, when the pressure bar 1 is pressed downward, the air inside the pump body 3 below the one-way valve 12 of the pressure bar 1 is squeezed to exhaust through the through-hole 52 of the base 5. As illustrated in FIGS. 1 and 2, two U-shaped frames 9 are pivotably secured to the base 5 at two opposite locations, which can be bilaterally turned down to a horizontal position to stabilize the positioning of the pump device on a flat surface.

Figure 4:
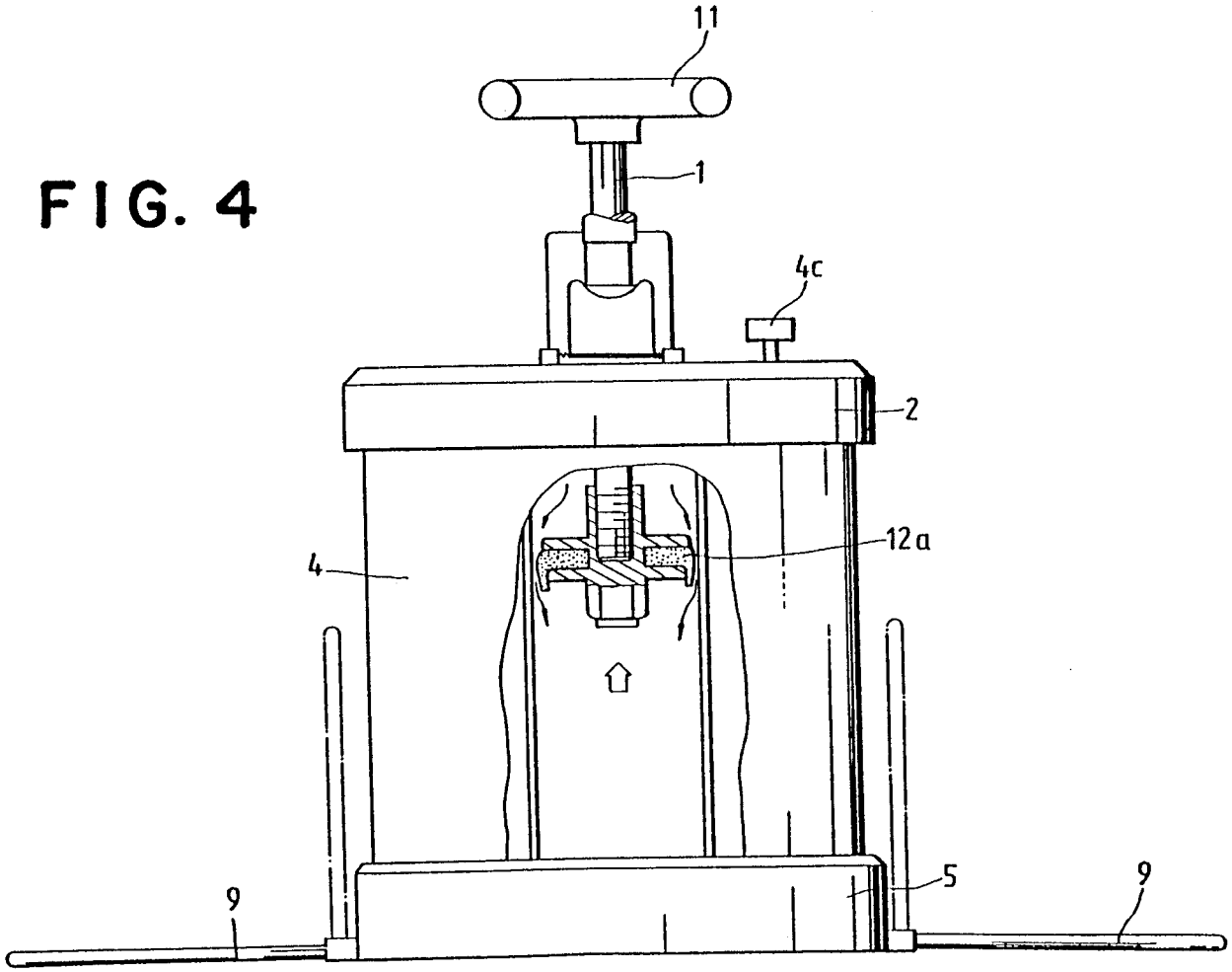
FIG. 4 is another sectional view of the present invention, in which the air in the upper space inside the pump body is squeezed to pass through the gap between the valve flap and the pump body into the lower space of the pump body.

Referring to FIG. 4, when the pressure bar 1 is pulled upward, the air inside the pump body 3 above the one-way valve 12 of the pressure bar 1 is simultaneouslY squeezed to pass through the gap between the inner wall surface of the pump body 3 and the valve flap 12*a* of the one-way valve 12 into the lower space inside the pump body 3. The upper space which is defined within the pump body 3 above the one-way valve 12 of the pressure bar 1, is in communication with an air outlet hole 4*a*, which is made on the bottom surface of the oil reservoir 4 below the upper cover 2, via the air intake hole 3*a* and the air channel 26*a*. Therefore, the air in the upper space of the inner cylinder 4*b* which is defined within the oil reservoir 4 immediately compensates the upper space of the pump body 3 when the air inside the upper space of the pump body 3 is squeezed to flow toward the lower space inside the pump body 3.

There is an oil suction inlet 23 made on the upper cover 2 with an oil suction pipe 7 secured thereto, which oil suction pipe 7 has a suction nozzle for insertion in an oil sump of a vehicle. When in use, the pressure bar 1 is pushed and pulled to turn the inner cylinder 4*b* of the oil reservoir 4 into a vacuum status so that residual engine oil can be induced from an oil sump of a vehicle into the inner cylinder 4*b*. The oil suction pipe 7 is collapsible and movably secured to the oil suction inlet 23 of the upper cover 2 by a bolt 71. When not in use, the oil suction pipe 7 can be turned to receive in a sleeve 4*d* which is vertically made on the side wall of the oil reservoir 4.

The floating choke valve 6 is set inside the air outlet hole 4*a* of the inner cylinder 4*b* to prohibit engine oil from flowing from the inner cylinder 4*b* into the pump body 3, which is comprised of an arch-shaped valve seat 61, a cylindrical float 62 and a conical head valve body 63. The valve seat 61 is fixedly secured to the bottom surface of the upper cover 2 with a guide tube 61*a* firmly set therein. The cylindrical float 62 is movably inserted in the guide tube 61*a* of the valve seat 61. The valve body 63 is fastened in the cylindrical float 62 from the top and disposed right below the air outlet hole 4*a* of the inner cylinder 4*b*. When the inner cylinder 4*b* of the oil reservoir 4 is filled with engine oil, the float 62 moves upward along the guide tube 61*a* to force the valve body 63 to block up the air outlet hole 4*a* so as to stop the formation of vacuum and protect inside engine oil from draining away through the air outlet hole 4*a*, the channel 26*a* and the one-way valve 52*a* of the base 5. Since the air outlet hole 4*b* is blocked up by the valve body 63, further vacuum will not formed inside the inner cylinder 4*b* of the oil reservoir 4 when the pressure bar 1 is continuously pressed down. There is a vacuum gage 4*c* mounted on the top of the upper cover 2. When the pointer of the vacuum gage 4*c* is gradually moving down, it means that certain quantity of engine oil has been collected in the inner cylinder 4*b* of the oil reservoir 4. A scale is made on the periphery of the oil reservoir 4 for checking how much engine oil has been sucked up from an oil sump of a vehicle.

Referring to FIG. 3 again, there is an air extraction hole 27 made on the rib 26 of the upper cover 2 in communication with the air channel 26*a*. An air pipe 29 is secured to the air extraction hole 27 for connection to a vacuum pump or an air intake manifold of a car engine (not shown). As soon as the control valve 28 which is mounted on the oil suction inlet 23 is closed, the inner cylinder 4*b* of the oil reservoir 4 can be extracted by a vacuum pump or an air intake manifold of a car engine into a vacuum status within a very short period of time (within few seconds according to actual test). When vacuum is formed inside the inner cylinder 4*b* of the oil reservoir 4, the control valve 28 is opened so that the negative pressure inside the inner cylinder 4*b* immediately induces residual engine oil to flow from an oil sump of a vehicle into the oil reservoir 4. In order to secure accurate performance of the present invention in sucking engine oil, three one-way valves 27*a*, 27*b* and 27*c* are respectively mounted in the air channel 26*a* between the air intake hole 3*a*, the air outlet hole 4*a* and the air extraction hole 27.

Figure 5:
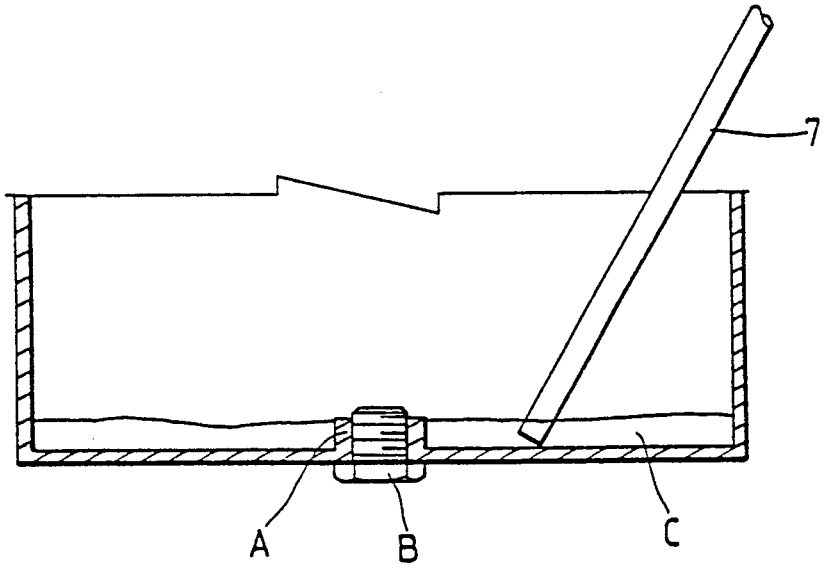
FIG. 5 is a schematic drawing illustrating the operation to insert an oil suction pipe in an oil sump of a vehicle for sucking engine oil into the oil reservoir.

Referring to FIG. 5, an oil sump of an automobile generally comprises a raised drain port A on its bottom for drainage and screwed up with a bolt B. When the bolt B is removed from the raised drain port A, the residual engine oil below the level of the raised bolt hole A can not be completely drained out of the oil sump. When the present invention is used, the oil suction pipe 7 can be inserted in the inner bottom of the oil sump at a position below the level of the raised bolt hole A so that the residual engine oil in the oil sump can be completely sucked up.

What is claimed:

1. A portable oil sump residual engine oil suction pump device, comprising:

an upper cover having a vertical wall downwardly around its periphery, a through-hole through its central axis and surrounded by a circular flange, an elongated rib extending from said circular flange and defining therein an air channel, said air channel having its both ends respectively in communication with said through-hole and the bottom surface of said upper cover, and a circular projection upstanding therefrom at the center;

a base having a vertical wall upwards around its periphery, a through-hole at its center and surrounded by an upstanding, circular projection, the through-hole of said base having an one-way valve set therein;

an oil reservoir being a cylindrical container, having its both ends respectively squeezed in between said base and said upper cover and sealed with an O-ring each at both ends thereof;

a pump body being received inside said oil reservoir and having its two opposite ends respectively fastened in the circular projection of said upper cover and the circular projection of said base and and sealed with an O-ring each at both ends thereof;

a pressure bar being an elongated rod inserted in said pump body with its top end protruding beyond said upper cover for the connection thereto of a hand-hold and with its bottom end coupled with an one-way valve permitting the upper space therein to be in communication with said air channel;

a floating choke valve having an arch-shaped valve seat fixedly secured to the bottom surface of said upper cover with a guide tube firmly set therein, a cylindrical float movably inserted in said guide tube of said valve seat, and a valve body fastened in said cylindrical float from the top and disposed right below an air outlet hole on said upper cover beneath said rib;

characterized in that the reciprocating up-and-down motion of said pressure bar forces said oil reservoir to exhaust air through an air exhaust hole on the bottom of said pump body so as to turn the inner space of said oil reservoir into a negative pressure status for inducing engine oil from an oil sump into said oil reservoir through an oil suction hole on said upper cover.

2. A portable oil sump residual engine oil suction pump device as claimed in claim 1, wherein an air extraction hole is made on said upper cover in communication with said air channel with an air pipe secured thereto for connection to a vacuum pump or an air intake manifold of a car engine; and said air channel has three one-way valves respectively fastened therein at three locations to control the passage through the inlet orifice and outlet orifice at its two opposite ends and the passage through said air extraction hole.

3. A portable oil sump residual engine oil suction pump device as claimed in claim 1, wherein said upper cover and said base have each a plurality of lugs transversely extending outward from its periphery with a through-hole each vertically piercing therethrough so that a plurality of bolts are vertically fastened through the lugs of said upper cover in the lugs of said base to firmly secure said upper cover and said base together.

* * * * *